US006407716B1

(12) United States Patent
Strickland et al.

(10) Patent No.: US 6,407,716 B1
(45) Date of Patent: Jun. 18, 2002

(54) BROADBAND DICHROIC SURFACE

(75) Inventors: Peter C. Strickland, Ottawa; Timothy E. Best, Elgin, both of (CA)

(73) Assignee: EMS Technologies Canada, Ltd., Ottawa (CA)

( * ) Notice: Subject to any disclaimer, the term of this patent is extended or adjusted under 35 U.S.C. 154(b) by 0 days.

(21) Appl. No.: 09/837,214

(22) Filed: Apr. 19, 2001

(51) Int. Cl.[7] ..... H01Q 21/26
(52) U.S. Cl. ..... 343/797; 343/909
(58) Field of Search ..... 343/705, 708, 343/797, 799, 897, 909; H01Q 21/26

(56) References Cited

U.S. PATENT DOCUMENTS 4,835,087 A * 5/1989 Bielli et al. ..... 430/318
4,860,023 A * 8/1989 Halm ..... 343/912
4,897,151 A * 1/1990 Killackey et al. ..... 156/630
4,931,805 A * 6/1990 Fisher ..... 343/715
H1219 H * 8/1993 Miller ..... 343/708
5,394,163 A * 2/1995 Bullen et al. ..... 343/771
6,198,457 B1 * 3/2001 Walker et al. ..... 343/840
6,281,852 B1 * 8/2001 Amarillas ..... 343/725

* cited by examiner

*Primary Examiner*—Tho Phan
(74) *Attorney, Agent, or Firm*—Harold C. Baker; Robert A. Wilkes; Robert G. Hendry

(57) ABSTRACT

The present invention provides a dichroic surface with a pointed resonator cross grid pattern that offers enhanced bandwidth and a sharper response between frequency bands. The dichroic surface is fabricated as a self-adhesive decal, conforming the dichroic surface to the surface of the reflector antenna.

19 Claims, 4 Drawing Sheets

BROADBAND DICHROIC SURFACE

FIELD OF THE INVENTION

The present invention relates to the design of a broadband dichroic surface and a method making such a surface.

BACKGROUND OF THE INVENTION

The design of microwave antennas for use in congested environments such as in the top of the stabilizer of an aircraft, places stringent limitations on the design of a rotating antenna. A dichroic reflector is one element of such an antenna structure. In such reflective antenna structures it is possible to design antenna reflectors, that will pass signals of one frequency band and reflect signals of other frequencies. The reflectors are called dichroic or frequency sensitive surfaces (FSS). The reflectors are normally made up of a large array of resonant elements, known as resonators. These resonators may be dipoles, of various configurations. The dipoles reflect certain frequencies while the dichroic surface also transmits the other frequencies. Based on the relative size of the dipoles, in relation to the dichroic surface, the reflection and transmission of frequencies is altered. Proper sizing of the dipoles will then determine the frequencies reflected while all other frequencies are transmitted.

The resonators are grouped into a grid formation on an antenna reflector to form a frequency-sensitive surface. The spacing between the resonator elements is an important design constraint in differentiating the reflected and transmitted bands.

The design and fabrication of such dichroic surfaces can be labour intensive and typically requires expensive equipment.

In known dichroic reflector techniques, conventional dichroic surfaces use blunt dipole crosses or tripole type elements that suffer from relatively narrow bandwidth. These elements produce a relatively narrow-band reflective surface due to the narrow resonances of the individual elements in the grid. The narrow resonance is due to the use of blunt ends on the elements that introduce discontinuities in the dichroic surface grid product and limit the corresponding packing density narrow resonance lines. Such surfaces are fabricated using vacuum forming, folded sheet or laser etching techniques. A number of patents disclose techniques for forming a dichroic surface implemented on an antenna reflector.

In U.S. Pat. No. 4,307,404, Young discloses a dichroic antenna system which uses a movable dichroic surface to scan multiple frequencies. Using at least one feed horn and a planar dichroic surface which can rotate about an axis, the differing phase shifts can be taken advantage of to scan selected frequencies. The method of constructing the dichroic surface is a conventional method of plating, masking, and etching of a metallic layer such as copper. Young uses thin rectangles on the dichroic surface as resonator elements.

In another U.S. Pat. No. 4,701,765, Arduini et al., discloses a multilayered dichroic antenna. Arduini shows two dichroic grids separated by a dielectric layer. The structure disclosed only reflects a single specific band of the electromagnetic spectrum. They disclose using a photoetching process of metallic layers deposited on dielectric layers.

In U.S. Pat. No. 4,814,785, Wu discloses a gridded square configuration for a dichroic surface. Wu also discloses the use of crosses, however, they are Jerusalem crosses (crosses with their arms terminated by a perpendicular bar). Regarding the fabrication method, the conventional method of etching on a substrate is disclosed. Due to the nature of the structure of the Jerusalem cross, there is a lower density of resonator elements per-unit area. Consequently, there is a maximum limit as to the amount of area covered by. the frequency selective surface and the resulting bandwidth of the surface is relatively narrow.

U.S. Pat. No. 4,835,087, Bielli et al., discloses a method of producing a dichroic surface using what may be termed as essentially conventional techniques. Bielli et al. use a computer controlled photographic projector to outline the resonator elements required on a substrate. However, to deposit the metallic conductive parts on the substrate, Bielli et al. use conventional chemical etching.

U.S. Pat. No. 4,897,151, Killackey et al. discloses a method of constructing a dichroic surface by essentially forming the metallic layer on a mandrel and then transferring the metallic layer to the final substrate. The main point of this patent is the use of a transfer technique whereby the layer is first formed on the mandrel and then transferred to substrate by having the adhesion between the metallic layer and the substrate be stronger than the adhesion between the layer and the mandrel. After the metallic layer is deposited, conventional photoresist imaging and chemical etching techniques form the grid pattern on the layer.

SUMMARY OF THE INVENTION

In contrast to the prior art cited above, the dichroic surface of the present invention has pointed resonator cross dipoles. The crosses are interlaced into a grid pattern to form a dichroic surface. The pointed ends allow the crosses to be packed with very high density and numerical analysis as well as testing indicate that this yields improved reflection bandwidth. The curvature of the antenna reflector further complicates the use of conventional techniques. The dichroic surface may be fabricated as a self-adhesive decal, conforming the dichroic surface to the surface of the reflector antenna. The decal eliminates using techniques, such as photoresist imaging and chemical etching, directly on the antenna structure.

The present invention provides a low cost dichroic surface with a pointed resonator cross grid pattern that offers enhanced bandwidth and a sharper response between frequency bands. In addition, the dichroic surface is used for broadband communications, where multiple bands of voice and data are being reflected and transmitted.

In one aspect, the invention provides a dichroic surface including a grid pattern of interlaced resonator elements, each resonator element being a resonator cross, each resonator cross having four equal length cross arms tapering to a point at each extremity of each cross arm, totalling four points per resonator cross, wherein each resonator possesses 90 degree rotational symmetry, each the form of a Greek pointed cross, and wherein the length of each cross arm forming the resonator cross, is one fourth a wavelength of the band to be reflected.

In a second aspect, the invention provides a dichroic surface deposited onto a supporting structure, which comprises a decal layer, having resonator elements, the decal layer is made of an electrically conductive metal, an adhesive layer and a decal backing. The decal layer adheres to a supporting structure using an adhesive layer; and the decal backing is discarded prior to adhering the resonator elements to the supporting structure.

BRIEF INTRODUCTION TO THE DRAWINGS

A better understanding of the invention will be obtained by a consideration of the detailed description below, in conjunction with the following drawings, in which.

DETAILED DESCRIPTION OF EMBODIMENTS OF THE INVENTION

In the field of antenna engineering and microwave communications, clarification of certain terms may enhance the understanding of this invention.

A band describes a range of frequencies, a frequency spectrum between two defined limits, measured in hertz (Hz). The bandwidth is then the difference, expressed also in hertz, between two boundaries of a frequency range. When referring to broadband, various signals are transmitted at various frequencies enabling transmission of large amounts of multi-media information, essentially voice and data. A bandpass filter is a device in which all signals outside a selected band are strongly attenuated, while the signal components lying within the band are passed with a minimum of change. A dichroic surface selectively transmits some wavelengths of radiation and reflects others. The dichroic surface can thus enable the separation of two bands, such as the Ka and Ku bands or L and Ku bands.

FIGS. 1A–1E represent various known frequency selective elements, also referred to as resonators. The shapes include rings (RI), cross dipoles (CD), square loops (SL), Jerusalem Cross (JC), and tripoles (TP).

Figure 1A:
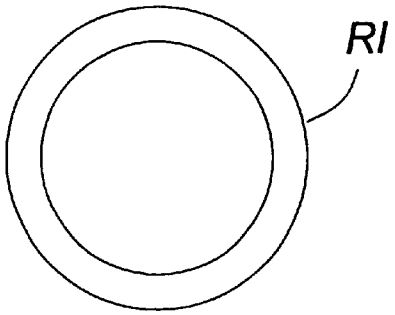
PRIOR ART FIG. 1A
FIGS. 1A–1E, illustrates a series of embodiments for selective antenna elements in the prior art.
Figure 1B:
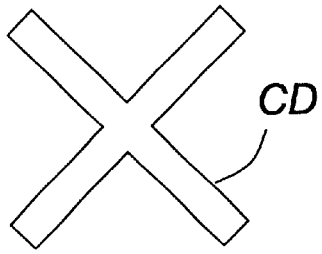
PRIOR ART FIG. 1B
Figure 1C:
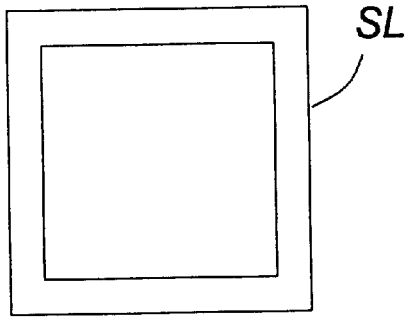
PRIOR ART FIG. 1C
Figure 1D:
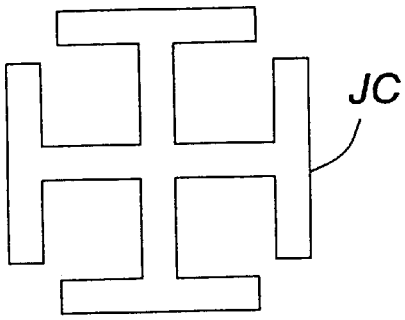
PRIOR ART FIG. 1D
Figure 1E:
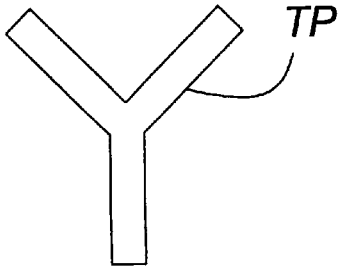
PRIOR ART FIG. 1E
Figure 2:
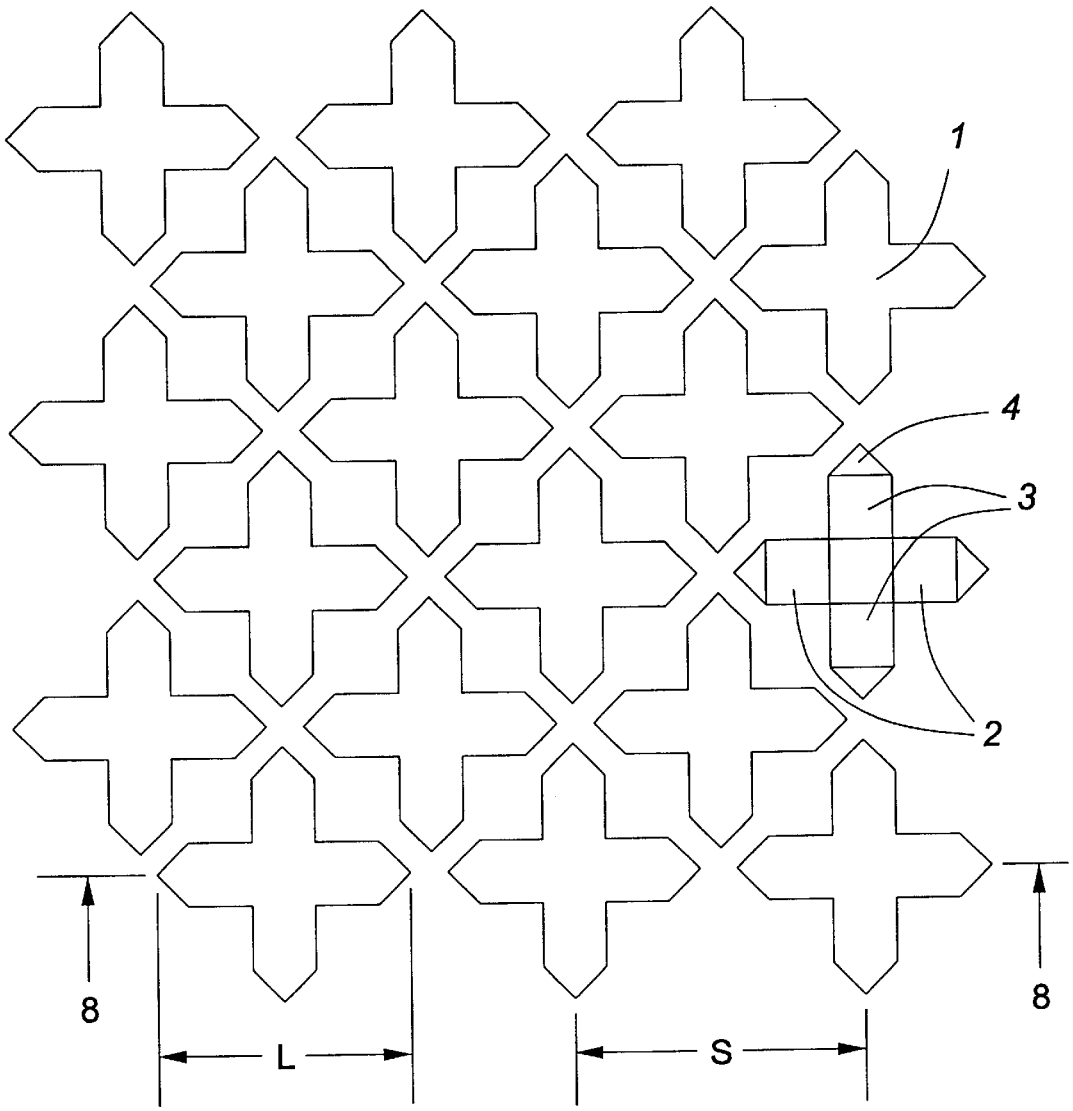
FIG. 2 illustrates a pointed cross dichroic surface of the present invention.

FIG. 2 is an illustration of the design of a dichroic surface of the invention. The grid pattern of interlaced resonator crosses is outlined. The resonator crosses 1 are sized, within the dichroic surface, to resonate at the desired band reflection frequencies. The surface of the crosses reject transmission (through the FSS) signals of certain frequencies, by reflecting those signals. The surface may be called a band-reject surface. The surface can also be constructed to pass signals of a certain frequency band. The points 4 at the end of the crossed arms increase the electrical length of the resonator while not affecting the required spacing (S). In addition, the points permit close coupling of the resonator crosses within the grid pattern.

The points 4 also increase the bandwidth of the individual crosses by reducing the effect of the discontinuities at the end of the pair of cross arms 2 and 3 and allowing tighter coupling to other elements in the grid. The length of the arms including the length of the points (L) determines the resonant frequency. The length L is typically slightly less than one half of a free space wavelength at the center frequency of the reflection band S is marginally larger than L as required to avoid ohmic contact between crosses. When constructing the cross, all four cross arms must be of equal length. Each pair of opposing cross arms 2,3 form a dipole. At each extremity of the cross there is a point. The points 4, as illustrated in FIG. 2, typically form an equilateral triangle. The base of the triangle is the same length as that of the width of the cross arm. The cross arms form the cross dipole with 90 degrees rotational symmetry. The length of each cross arm is roughly one fourth a wavelength. This resonator element is also known as a Greek Cross.

The cross dipole with points permits a tight interlacing of the grid pattern. As previously explained, the close coupling of the dipoles increases the bandwidth of the reflected frequencies, while decreasing the band of frequencies that are transmitted through the FSS. It is important to note that signals reflected by the FSS are transmitted or received by the antenna.

Figure 3:
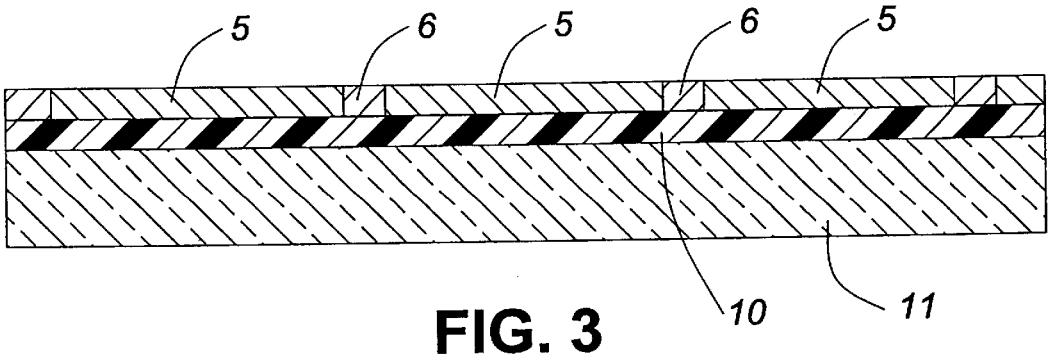
FIG. 3 illustrates a decal construction of a first embodiment of the present invention.

FIG. 3 illustrates the layers in the decal construction in vertical section on the line 8—8. The figure shows the side view of the decal backing 11 carrying the resonator crosses 5 attached to the decal backing material 11. The decal backing is a supporting carrier that is discarded after the resonator crosses 5 are peeled off and placed on a supporting substrate. The unwanted portion 6 of the decal surface is peeled away from the resonator crosses 5. In addition, the unwanted portion 6 of the decal surface may be removed prior to or after sticking the decal to the supporting structure. The adhesive layer 10 ensures that the crosses adhere to the supporting structure and holds them in contact with the decal backing 11 prior to assembly of the dichroic reflector.

The grid of resonator crosses and the unwanted portion 6 outlining the grid is an electrically conductive metal layer. The metal used may be a copper, aluminum, gold, or any other conductive metal. The acrylic adhesive 10 attaches the decal layer 5,6 to a dielectric composite. The composite forms another layer within the adhesive layer 10, between the decal and the supporting antenna structure.

Figure 4:
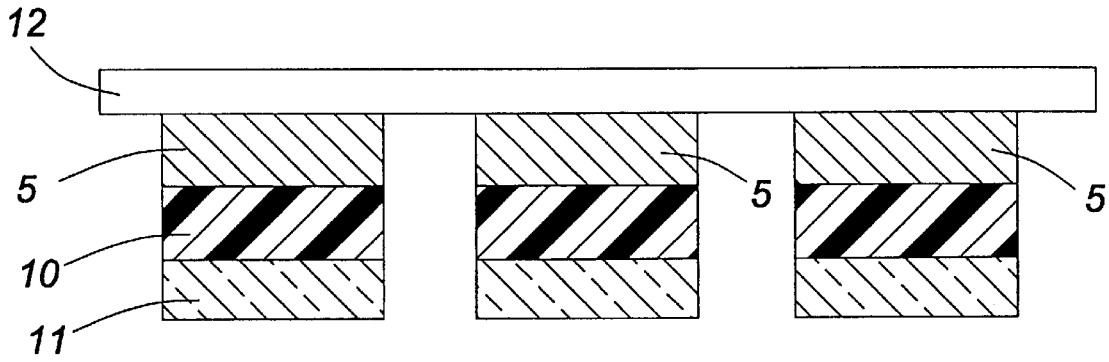
FIG. 4 illustrates a second embodiment of the present invention.

Computer assisted machining (CAM) is a well-known tool in the engineering field. The use of a CAM system to cut crosses yields consistent results and ensures the accuracy of the size of the resonator crosses, as well as their relative position and location with respect to one another in the resonator pattern. As shown in FIG. 4, the resonator pattern may be cut in the decal layer on a copper clad tape. The copper clad tape includes an acrylic adhesive 10 and decal layer 5,6. The acrylic adhesive 10 must be suitably transparent to certain radio frequencies received by a supporting antenna structure. A low tack masking tape 12, which is suitably resistant to tearing, is applied to the decal layer 5 side of the clad tape prior to the positioning of the material on the knife cutter. The decal backig 11 is facing the cutting instrument.

Figure 5:
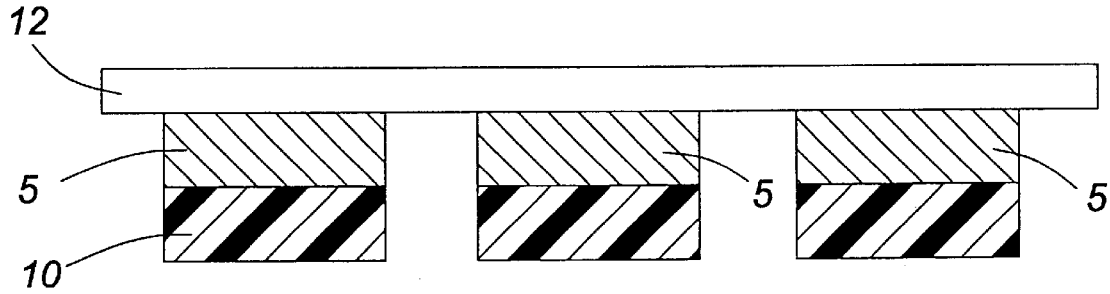
FIG. 5 illustrates a third embodiment of the present invention.

The resonator pattern may be fabricated using computer numeric control (CNC) knife cutting equipment. The pressure on the cutting knife is set so that, as it traces the outline of the resonators, the knife will cut the acrylic layer 10 and metallic layers 5 but not the low tack masking tape 12. As shown in FIG. 5, once the outline of the resonator pattern is complete, the decal backing 11, can be removed, while maintaining the relative location of the resonator crosses to one another.

Figure 6:
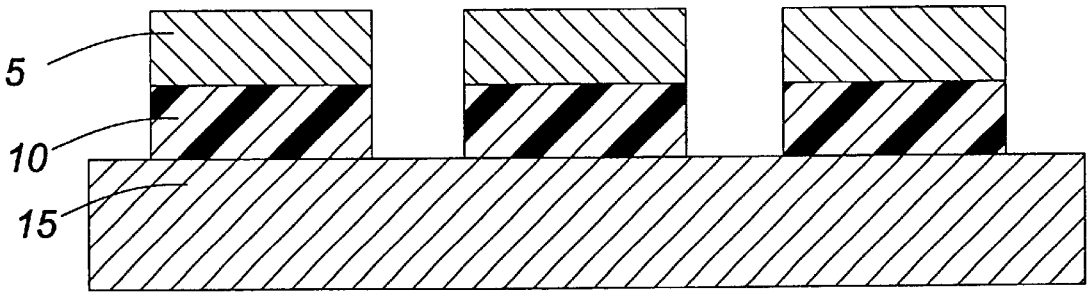
FIG. 6 illustrates a fourth embodiment of the present invention.

FIG. 6 illustrates the resonator crosses 5 adhered to the supporting structure 15. The adhesive layer is an intermediary layer between the crosses and the supporting structure. The low tack masking tape, shown in FIG. 5, is discarded once the resonator crosses have been placed on the supporting structure.

Figure 7:
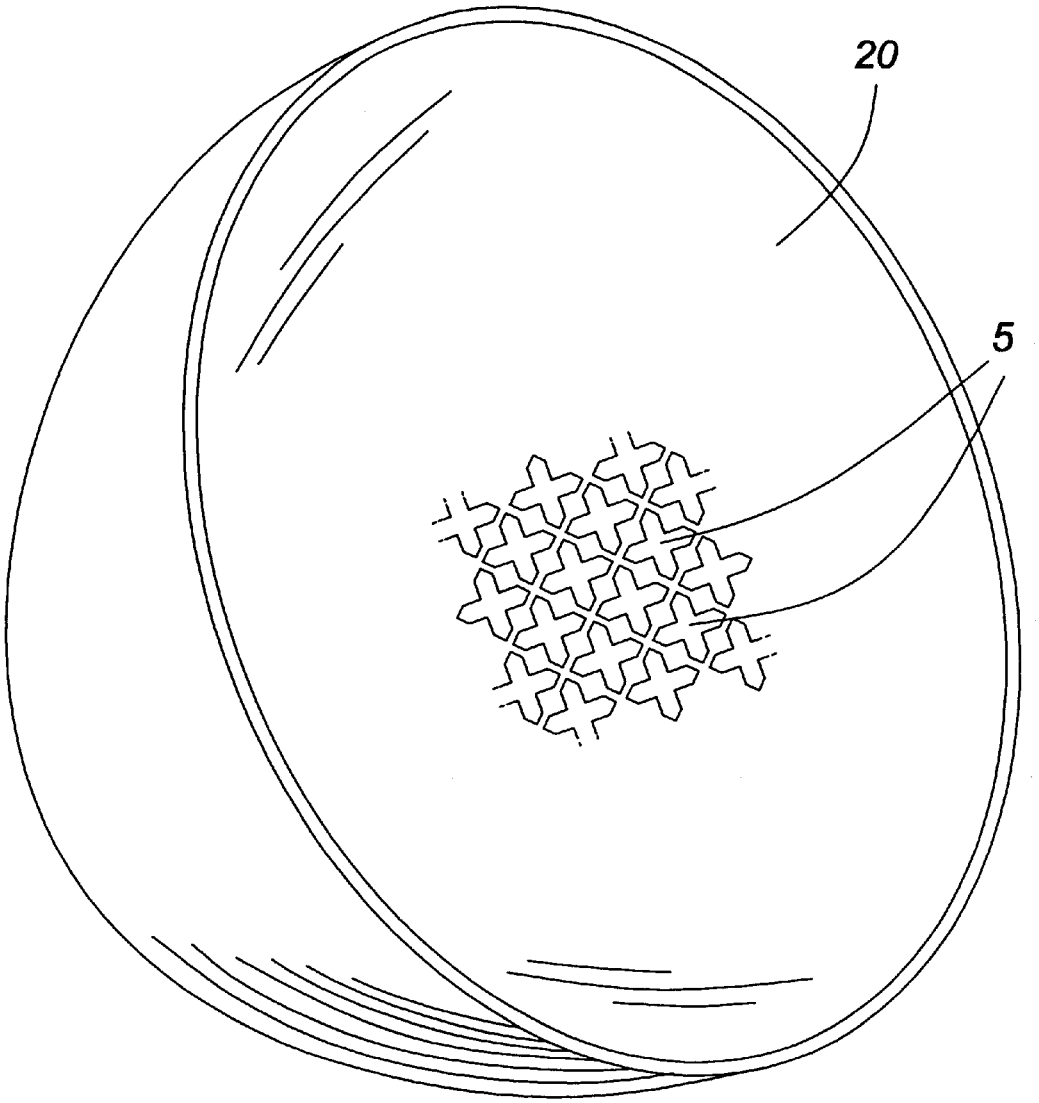
FIG. 7 illustrates a fifth embodiment of the present invention.

Prior to fixing the decal layer onto the supporting structure, it is prepared for bonding. This process can be a light mechanical abrasion and solvent wipe on the supporting structure. To overcome the difficulty of placing the flat surface decal of resonator crosses 5 onto a paraboloidal structure 20, as shown in FIG. 7, the resonator pattern may be split into four quadrants to accommodate the curvature of the structure. The decal may also be split into long strips of varying lengths to cover the paraboloid. For each quadrant, a flat sheet of decal is fabricated.

Another application method consists of fabricating the decals directly onto a male mould. Once the supporting structure is cured and the mould removed, the acrylic adhesive is removed using a solvent and the resonators are secured by the resin. Resin has strong bonding properties with the reflector substrate, as such, this method of resonator attachment is extremely durable and eliminates the acrylic adhesive which hinders RF performance. The male mould may be fabricated from a metal in which case a solvent may be required to facilitate removal of the reflector after curing.

This dichroic surface has several industrial applications. One application is the use of a dichroic surface antenna for reception on an aircraft. In broadband satellite communications, the present invention increases the bandwidth of the dichroic surface for real-time video broadcast. The antenna surface is paraboloidal, with the dichroic pattern being supported by a lightweight dielectric composite. In this particular application, the composite has thin dielectric outer skins separated by a low permittivity core. This results in low average permittivity. The antenna is typically mounted within the tail of an aircraft. There may be other antennas used for other applications, such as L-band satellite voice transmission and reception. The antenna, in close proximity to other antennas, can have a dichroic surface that will reflect certain frequencies while others remain transparent to others. For example, the purpose of the dichroic surface may be to allow the paraboloidal antenna to receive the Ku-band (10.9 to 17 GHz) video broadcasts while being transparent to the L-band (0.5 to 1.5 Ghz) voice frequencies used by another antenna.

A person understanding the above-described invention may now conceive of alternative designs, using the principles described herein. All such designs which fall within the scope of the claims appended hereto are considered to be part of the present invention.

We claim:

1. A dichroic surface, including a grid pattern of interlaced resonator elements, each resonator element being a resonator cross, each resonator cross having four equal length cross arms tapering to a point at each extremity of each cross arm, totalling four points per resonator cross;

wherein each resonator cross possesses 90 degree rotational symmetry, and each the form of a Greek pointed cross;

wherein the length of each cross arm forming the resonator cross, being one fourth a wavelength of the band to be reflected.

2. A dichroic surface deposited onto a supporting structure, which comprises:

(a) a decal layer, forming a grid pattern of interlaced resonator elements, the decal layer is made of an electrically conductive metal;

(b) an adhesive layer; and (c) a decal backing;

wherein the decal layer adheres to the supporting structure using the adhesive layer; and wherein the decal backing is discarded prior to adhering the resonator elements to the supporting structure.

3. A dichroic surface as in claim 2, wherein the supporting structure is an antenna structure.

4. A dichroic surface as in claim 3, wherein the antenna structure is a reflector.

5. A dichroic surface as in claim 4, wherein the reflector is a paraboloid.

6. A dichroic surface as in claim 3, wherein the adhesive layer is adhered to a dielectric composite that supports the decal layer on the supporting structure.

7. A dichroic surface as in claim 6, wherein the dielectric composite is a composite of thin dielectric skins, said dielectric skins having an inner core of low permittivity.

8. A dichroic surface including a grid pattern of interlaced resonator elements, each resonator element being a resonator cross, each resonator cross having four equal length cross arms tapering to a point at each extremity of each cross arm, totalling four points per resonator cross wherein each resonator possesses 90 degrees rotational symmetry, and each the form of a Greek pointed cross;

wherein the length of each cross arm forming the resonator cross, being one fourth wavelength of the band to be reflected.

9. A dichroic surface as in claim 8, wherein the point located at each extremity of the cross arm permits close coupling of the resonator crosses within the grid pattern.

10. A dichroic surface as in claim 8, wherein the grid pattern of resonator elements are non-uniformly spaced.

11. A dichroic surface including a grid pattern of interlaced resonator elements, each resonator element being a resonator cross, each resonator cross having four equal length cross arms tapering to a point at each extremity of each cross arm, totalling four points per resonator cross wherein each resonator possesses 90 degrees rotational symmetry, and each the form of a Greek pointed cross;

wherein the length of each cross arm forming the resonator cross, being one fourth wavelength of the band to be reflected, wherein the resonator elements act as a band-reject surface, the unwanted frequencies being reflected, passing all other frequencies through to an antenna structure.

12. A dichroic surface as in claim 11, wherein the antenna structure, is mounted on an aircraft.

13. A dichroic surface as in claim 12, wherein the antenna receives Ku band frequencies, and is transparent to L-band and other frequencies.

14. A method of producing a dichroic surface using a sticker having:

(a) a decal layer, forming a grid pattern of interlaced resonator elements, the decal layer is made of an electrically conductive metal;

(b) an adhesive layer; and (c) a decal backing, wherein the decal layer adheres to a supporting structure using the adhesive layer;

wherein the decal backing is discarded prior to adhering the resonator elements to the supporting structure; and the method comprising the steps of:

(a) orienting the decal layer side upwards and, positioning the resonator elements with respect to each one on a supporting structure;

(b) fabricating a resonator element grid pattern using the decal layer by cutting individual resonator elements in the decal layer;

(c) adhering the resonator elements to the supporting structure;

(d) removing the unwanted portion surrounding the resonator elements;

(e) removing the decal backing once the resonator elements are adhered to the supporting structure.

15. A method of producing a dichroic surface as in claim 14, including fabricating the resonator element grid pattern on the decal layer by manually cutting the individual resonator crosses.

16. A method of producing a dichroic surface as in claim 14, including fabricating the resonator element grid pattern by using computer controlled cutting equipment.

17. A method of producing a dichroic surface as in claim 14, wherein the supporting structure is a paraboloidal structure.

18. A method as in claim 17, further including the dichroic surface divided into a grid structure with four quadrants to accommodate the paraboloidal structure, and adhering each quadrant separately onto the paraboloidal structure.

19. A method as in claim 17, further including dividing the dichroic surface into a plurality of strips, said plurality of strips being sufficient to cover the paraboloidal structure, each strip being adhered separately on the paraboloidal structure.

* * * * *